US011459869B2

(12) United States Patent
Mansir et al.

(10) Patent No.: US 11,459,869 B2
(45) Date of Patent: Oct. 4, 2022

(54) SHAFT SEAL PROTECTOR FOR ELECTRICAL SUBMERSIBLE PUMPS

(71) Applicant: CORETEQ SYSTEMS LTD, Camberley (GB)

(72) Inventors: Hassan Mansir, Berkshire (GB); Andras Bencze, Hampshire (GB)

(73) Assignee: CORETEQ SYSTEMS LTD, Camberley (GB)

( * ) Notice: Subject to any disclaimer, the term of this patent is extended or adjusted under 35 U.S.C. 154(b) by 351 days.

(21) Appl. No.: 16/754,043

(22) PCT Filed: Oct. 4, 2018

(86) PCT No.: PCT/GB2018/052837
§ 371 (c)(1),
(2) Date: Apr. 6, 2020

(87) PCT Pub. No.: WO2019/069083
PCT Pub. Date: Apr. 11, 2019

(65) Prior Publication Data

US 2020/0325757 A1 Oct. 15, 2020

(30) Foreign Application Priority Data

Oct. 6, 2017 (GB) ..... 1716441

(51) Int. Cl.
*E21B 43/38* (2006.01)
*E21B 43/12* (2006.01)
(Continued)

(52) U.S. Cl.
CPC ..... *E21B 43/38* (2013.01); *E21B 43/128* (2013.01); *F04D 13/10* (2013.01); *F04B 47/06* (2013.01); *F04D 13/086* (2013.01)

(58) Field of Classification Search
CPC .... F04D 13/086; F04D 47/06; F04D 13/0653; F04D 13/08–10; F04D 29/2288–2294;
(Continued)

(56) References Cited

U.S. PATENT DOCUMENTS 3,288,075 A * 11/1966 Lung ..... F04D 13/10 415/121.2
4,913,630 A 4/1990 Cotherman et al.
(Continued)

FOREIGN PATENT DOCUMENTS

CN 200955384 Y 10/2007

OTHER PUBLICATIONS

International Search Report and Written Opinion in International Application No. PCT/GB2018/052837 dated Jan. 2, 2019, 11 pages.

*Primary Examiner* — Alexander B Comley
(74) *Attorney, Agent, or Firm* — Conley Rose, P.C.; Rodney B. Carroll

(57) ABSTRACT

Disclosed is an apparatus when installed with an Electrical Submersible Pump for fluid production protects the motor from the effect of solids on the shaft seal. The invention provides an apparatus that dynamically filters the solids and prevents them from contacting or accumulating at the vicinity of the shaft seal. The apparatus extends the run life of the ESP and prevents the motor dielectric fluid from being contaminated.

13 Claims, 5 Drawing Sheets

(51) Int. Cl.
*F04D 13/10* (2006.01)
*F04B 47/06* (2006.01)
*F04D 13/08* (2006.01)

(58) Field of Classification Search
CPC ..... E21B 43/128; E21B 43/34; E21B 43/35; E21B 43/38
USPC ..... 166/105.5, 357
See application file for complete search history.

(56) References Cited

U.S. PATENT DOCUMENTS

| | | | | |
|---|---|---|---|---|
| 5,525,146 | A | 6/1996 | Straub | |
| 2005/0281683 | A1 | 12/2005 | Brown et al. | |
| 2013/0319956 | A1 | 12/2013 | Tetzlaff et al. | |
| 2014/0216720 | A1* | 8/2014 | Wang ..... | B01D 19/0052 96/216 |

* cited by examiner

SHAFT SEAL PROTECTOR FOR ELECTRICAL SUBMERSIBLE PUMPS

CROSS-REFERENCE TO RELATED APPLICATION(S)

This application is a national stage entry from International Application No. PCT/GB2018/052837, filed on Oct. 4, 2018, published as International Publication No. WO 2019/069083 A1 on Apr. 11, 2019, and claims priority under 35 U.S.C. § 119 from United Kingdom Patent Application No. GB 1716441.9, filed on Oct. 6, 2017, the entire contents of all of which are incorporated herein by reference.

This invention relates to a device to protect the mechanical shaft seal on a protector from impurities/sand in the well bore fluid, used in Electrical Submersible Pumps (ESPs) deployed in a borehole.

BACKGROUND OF THE INVENTION

Electric Submersible Pump (ESP) systems provide an efficient and reliable artificial-lift method for pumping a variety of production fluids from wellbores. The ESP system typically comprises a multi-staged centrifugal pump, a motor protector (also referred to as "seal-section") and a motor in an enclosed unit. In an ESP system, the motor protector has three functions, namely;

It provides a rotating seal to protect the motor oil from contamination by the wellbore fluid. The motor is filled with a high-dielectric mineral or synthetic oil for electrical protection and lubrication. This oil communicates with the oil in the motor protector. Well fluid migrating into the protector and motor can cause premature electrical or mechanical failures through the reduction of the motor oil dielectric withstand characteristics or lubricating properties.

It also provides a location for the thrust bearings that absorbs the axial thrust produced by the pump and dissipates the heat that the thrust bearing generates. It also equalises pressure between the interior of the motor and the wellbore. Its design allows for a breathing or equalization method that compensates for pressure differentials caused by the wellbore pressure encountered during the installation from surface pressure to downhole static pressure and the thermal expansion and contraction of the motor oil during operation.

Many protectors employ seal bags, labyrinth chambers and other separation mechanisms to accommodate the volumetric changes and movement of fluid in the protector while providing an effective barrier between clean motor dielectric fluid and contaminated wellbore fluid. Protectors include one or more rotating shafts that transfer torque from the motor to the pump and the fluid separation means must be designed to accommodate the shaft. Thus, mechanical face seals are placed around the shaft to prevent fluids from migrating through the protector. It is accepted that the mechanical seals are susceptible to failure in certain environments. As wellbore fluids are drawn into the mechanical shaft seal area from the open pump intake, sand and other solids can accumulate in close proximity to the shaft seal. The high concentration of solid particles in the vicinity of the shaft seal degrades its performance characteristics and compromises the sealing surfaces resulting in failure. The accumulation of solids may also plug the outlet of the check valve that provides a vent for the expanding motor dielectric oil into the well bore. This compromises the pressure compensations mechanism and causes a pressure build up inside seal section that may result in the seal faces separation exacerbating the wear and scoring of the seal faces when solid particles are present. When this occurs, well fluid and solids enter the clean oil section of the seal compromising its function.

In conventional ESP systems, seal failures due to sand ingress and the consequential damages to the motor account for approximately 56% of all failures. This is significant and need tackling to increase ESP run life.

Many methods and apparatus have been devised and implemented by the industry to overcome the run life limiting operational performance of the protectors including solid barriers and multiple seal sections that provide redundancy. None of these solutions provide a satisfactorily protection from solid contamination in ESP systems. Therefore, there is a need for an additional apparatus, system and method for protecting the seal section of ESP assemblies. One object of the present invention to provide an apparatus and method for protecting the top mechanical shaft seal and preventing the solids from contaminating the seal area, although the invention has other areas of application.

SUMMARY OF THE INVENTION

According to the present invention, there is provided a solids separator according to claim 1.

The apparatus may be used in conjunction with protector to draw in wellbore through a multi-stage dynamic filter and flush continuously the outermost top mechanical shaft seal in the protector with clean well bore fluid.

The terms 'inlet' and 'outlet' used herein are not restricted to pathways directly to and from the wellbore, but include pathways to and from other stages or apparatus of downhole equipment.

BRIEF DESCRIPTION OF THE DRAWINGS

FIG. 6 shows the top mechanical shaft seal of the protector. The right hand view cuts through one of the inlets, and two of the exhausts to show their position.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to an apparatus and method for reducing detrimental effects of sand laden well bore fluid on motor protector mechanical shaft seal. The system and method are useful with, for example, a variety of downhole production systems, such as electric submersible pumping systems. However, the devices and methods of the present invention are not limited to use in the specific applications that are described herein.

Figure 1:
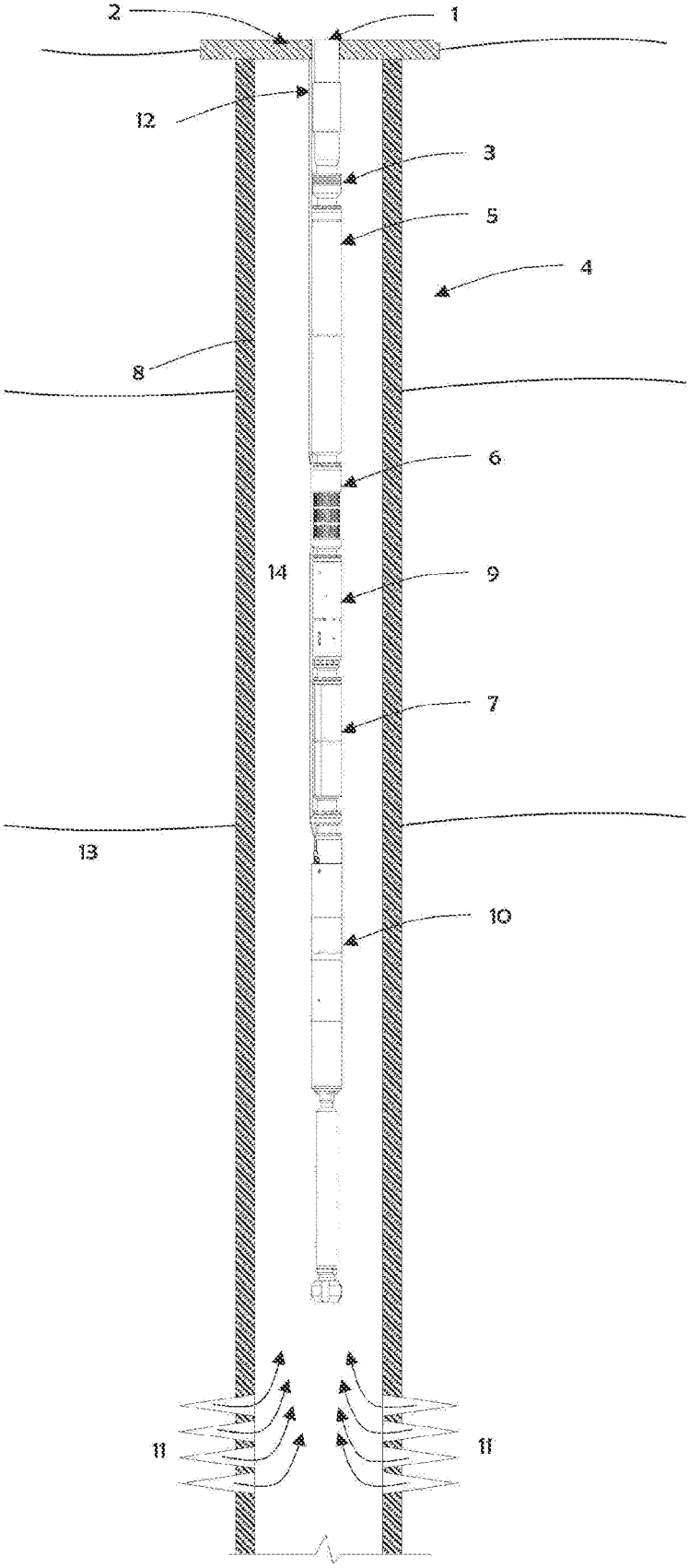
FIG. 1 is a front elevation view of an Electric Submersible Pumping (ESP) system disclosed in a wellbore, according to an embodiment of the present invention.

Referring generally to FIG. 1, an example of a pumping system 4, such as an electric submersible pump system, is illustrated according to an embodiment of the present invention. Pump system 4 may comprise a variety of components depending on the particular application or environment in which it is used. In this example, however, pumping system 4 includes a centrifugal submersible pump 5, a pump intake 6, a solids separator 9, a motor protector 7, and a submersible motor 10.

Pumping system 4 is designed for deployment in a wellbore 14 within a geological formation 13 containing desirable production fluids, such as water or crude. The wellbore 14 typically is drilled and lined with a wellbore casing 8. Wellbore casing 8 includes a plurality of openings or perforations 11 through which production fluids flow from formation 13 into wellbore 14.

Pumping system 4 is deployed in wellbore 14 by a deployment system 2 that may have a variety of forms and configurations. For example, deployment system 2 may comprise tubing, such as coil tubing or production tubing, connected to pump 5 by a connector 3. Power is provided to submersible motor 10 via a power cable 12. Motor 10, in turn, powers pump 5 which draws production fluid in through a pump intake 6, and pumps the production fluid to the surface via tubing 1.

It should be noted that the illustrated submersible pumping system 4 is merely an example. Other components can be added to this system and other deployment methods may be implemented (i.e. rigless-wireline). Additionally, the production fluids may be pumped to the surface through tubing 1 or through the annulus formed between deployment system 2 and wellbore casing 8. In any of the many potential configurations of submersible pumping system 4, motor protector 7 is conventionally used to seal the submersible motor 10 from fluid in wellbore 14 and to generally balance the internal pressure within submersible motor 10 with the external pressure in wellbore 14; as discussed below, although the system described herein is suitable for use with a motor protector, the motor protector is no longer an absolute necessity.

Figure 2:
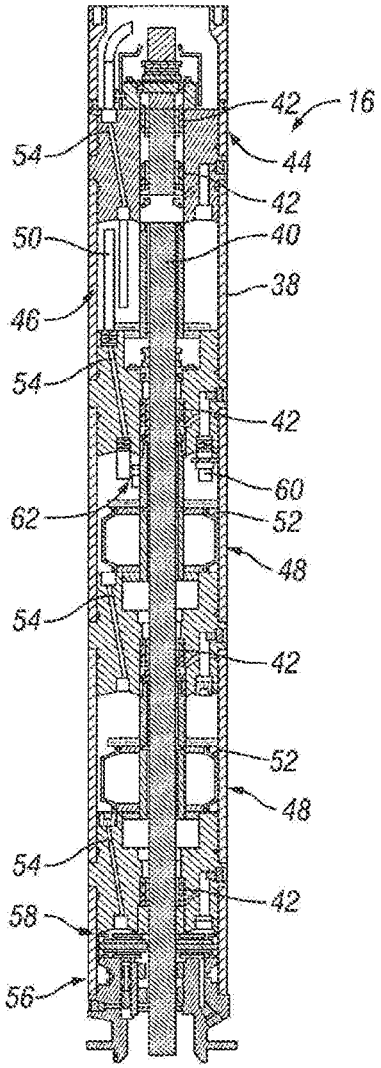
FIG. 2 is a longitudinal sectional view taken generally along an axis of a known motor protector illustrated in FIG. 1.

Referring generally to FIG. 2, an embodiment of a typical motor protector 7 is illustrated in greater detail. Motor protector 7 comprises an outer housing 38 within which a drive shaft 40 is rotatably mounted via a plurality of bearings 42, such as journal bearings. Outer housing 38 may be formed of one or more housing components. Also, the motor protector 7 is divided into a plurality of sections, including a head section 44 disposed generally at an upper end of the protector. An additional section (or sections) is disposed below head section 44 and functions as a fluid separation section to separate wellbore fluid that may enter head section 44 from internal motor oil used to lubricate submersible motor 10. The sections also facilitate balancing of internal and external pressures. In the embodiment illustrated, a labyrinth section 46 is disposed below head section 44, and a pair of elastomeric bag sections 48 are disposed below labyrinth section 46.

Labyrinth section 46 comprises a labyrinth 50 tubes that uses the difference in specific gravity of the well fluid and the internal motor oil to maintain separation between the internal motor oil and the well fluid. Each bag section uses an elastomeric bag 52 to physically isolate the internal motor oil from the wellbore fluid. It should be noted that the motor protector sections may comprise a variety of section types. For example, the motor protector may comprise one or more labyrinth sections, one or more elastomeric bag sections, combinations of labyrinth and bag sections as well as other separation systems. A series of fluid ports or channels 54 connect each section with the next sequential section. In the embodiment illustrated, a port 54 is disposed between head section 44 and labyrinth section 46, between labyrinth section 46 and the next sequential bag section 48, between bag sections 48 and between the final bag section 48 and a lower end 56 of motor protector 7.

Motor protector 7 may comprise a variety of additional features. For example, a thrust bearing 58 may be deployed proximate lower end 56 to absorb axial loads applied on shaft 40 by the pumping action of submersible pump 5. The protector also may comprise an outward relief mechanism 60, such as an outward relief valve. The outward relief valve releases excessive internal pressure that may build up during, for example, the heating cycle that occurs with start-up of electric submersible pumping system 10. Motor protector 7 also may comprise an inward relief mechanism 62, such as an inward relief valve. The inward relief valve relieves excessive negative pressure within the motor protector. For example, a variety of situations, such as system cool down, can create substantial internal pressure drops, i.e. negative pressure, within the motor protector. Inward relief mechanism 62 alleviates the excessive negative pressure by, for example, releasing external fluid into the motor protector to reduce or avoid mechanical damage to the system caused by this excessive negative pressure.

Figure 3:
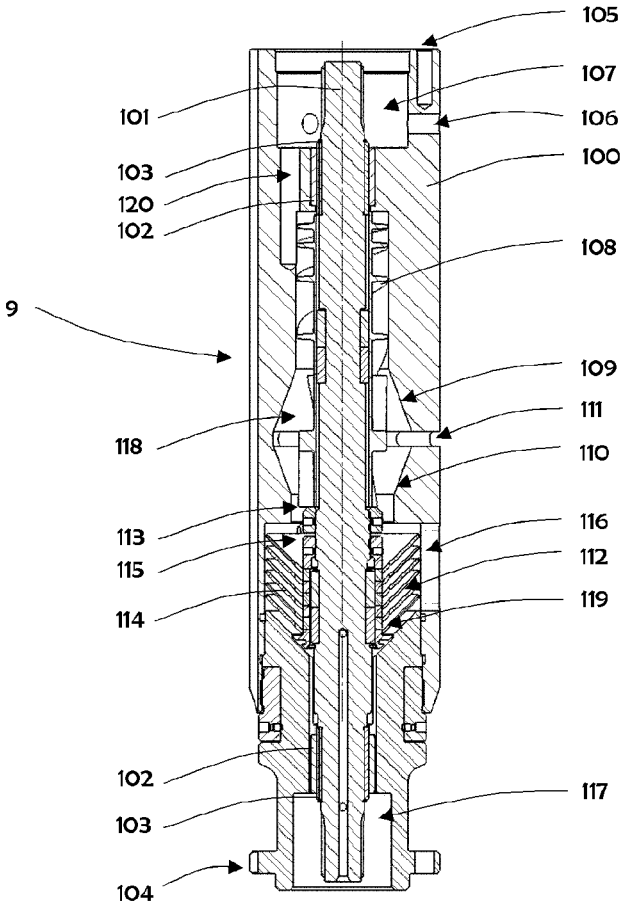
FIG. 3 is a longitudinal section side view of the solids filtration apparatus as illustrated in FIG. 1.

Referring to FIG. 3 there is shown a housing 100 with a flange 104 which connects to the output of a motor, typically via a protector (not shown in this figure). The assembly has a shaft 101 passing through its centre, which is mounted in bearings 102 and 103 (journal bearing). The outer housing 100 extends to an upper flange 105. Ports 106 allow wellbore fluid to be drawn into the chamber 107 which is the inlet to the flow inducer-separator 108 through axial ports 120. The flow inducer-separator rotates with the shaft 101. The flow inducer-separator provides kinetic energy to the fluid and the solids are transferred to the first separation zone 118. Slopes 109 and 110 (which in three dimensions form conical surfaces) lead towards the exit ports 111. The solids will travel on the slopes 109 and 110 before existing the first separation cavity 118. With the turning of the flow inducer-separator 108, as fluid and suspension mixture is introduced into the inducer-separator from the chamber 107, the separator draws and separates the solids and water to flow along the slopes 109 and 110 while the lower density fluid will continue its flow to the second separation zone 112.

The fluid with finer solids passes forward along the device through the inlet 113 into the second separation zone 112. The solids in the mixture will be filtered by the action of a series of funnel shaped centrifugal impellers 114. The clean fluid remains near the shaft 101 and the finer solid exits the cavity 115 through multiple axial channels in the housing 116. The clean fluid travels axially through ports 119 in the centrifugal impellers 114 and the annular gap 124 and flows through bearings 102 and 103 and into clean cavity 117. Additional holes in the housing, not shown, will allow more clean fluid in the clean cavity 117.

Figure 4:
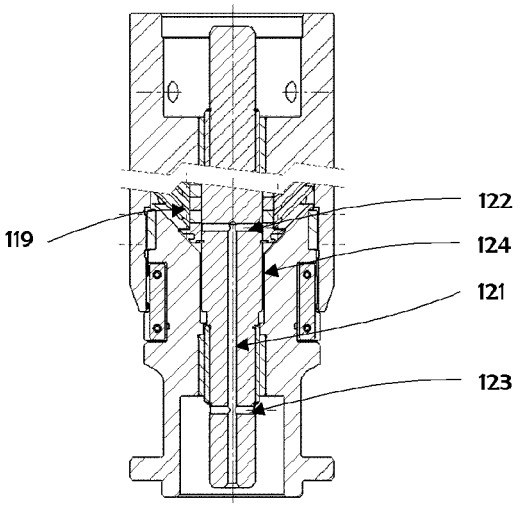
FIG. 4 is a detailed section side view of the solid filtration apparatus bottom section shown in FIG. 3.

In another embodiment shown in FIG. 4, the clean fluid is circulated through an axial bore 121 drilled in shaft 101. The fluid is taken out of the clean cavity 117 and pumped through a radial hole 123 and back in the clean fluid area through another shaft radial hole 122. Clean fluid circulates and lubricates journal bearings 102 and 103. At all times, clean area 117 is fed with clean fluid that protects the protector top mechanical shaft seal (not shown).

Figure 5:
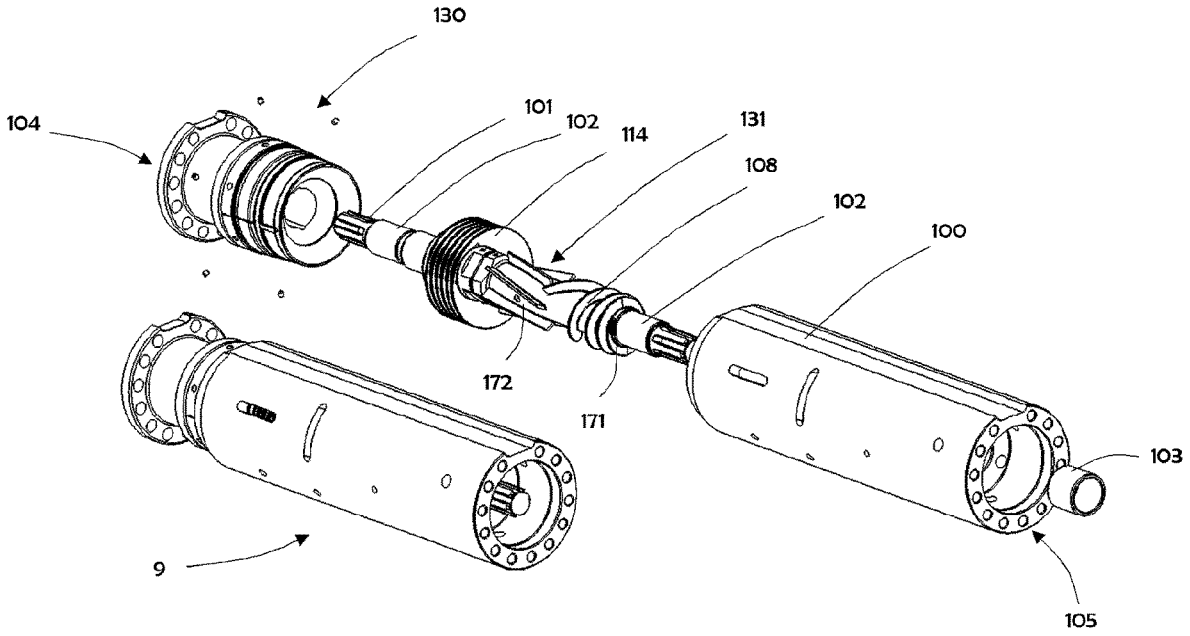
FIG. 5 is an exploded view of the elements of a solids separator as illustrated in FIG. 3.

Referring to FIG. 5 there is shown the exploded view of the assembly 9 containing sub-assemblies 130 and 131. The solid separator shaft assembly has two bearings 102, an inducer 108 and a fine solid separator 114. The inducer 108 is shown in this illustration as a variable pitch auger 171 followed by a wide pitch impeller 172. However many configurations are usable in this apparatus and possibly with fixed pitch and straight impeller.

Figure 6:
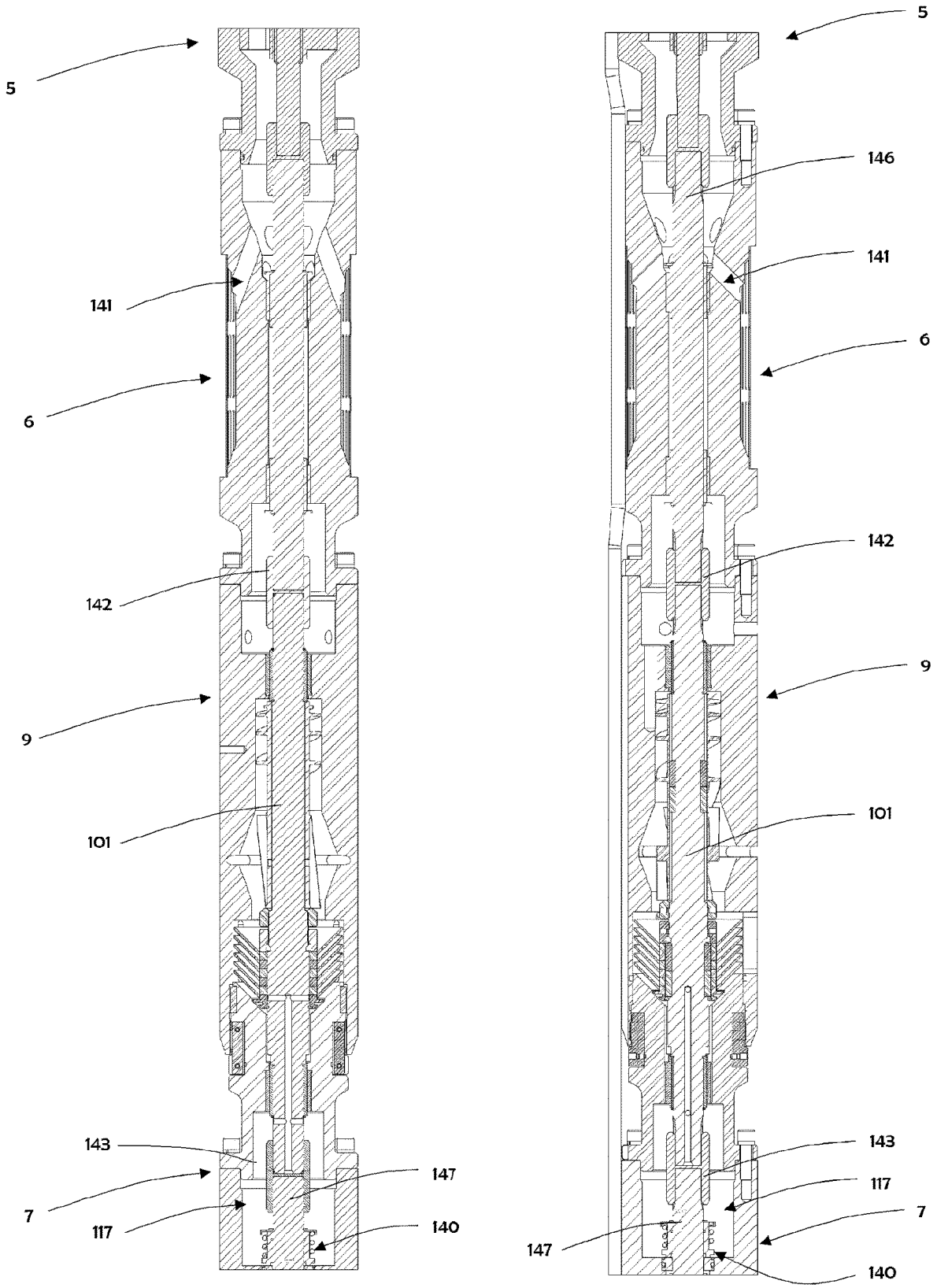
FIG. 6 shows two longitudinal sectional side views in different planes of the solids separator illustrated in FIG. 3 fitted between the protector and pump inlet.

Referring to FIG. 6 there is shown the overall assembly of the ESP string with the solid separator installed. The shaft 101, transmitting the power through the solids separator, drives the pump intake shaft 146 via a coupling 142. The power is transferred from the shaft 147 of the protector 7 from the motor (not shown) through coupling 143. The mechanical shaft seal 140 of the protector 7 is located in the clean cavity 117. The cavity 117 is maintained clean by the action of the solid separator 9.

Figure 7:
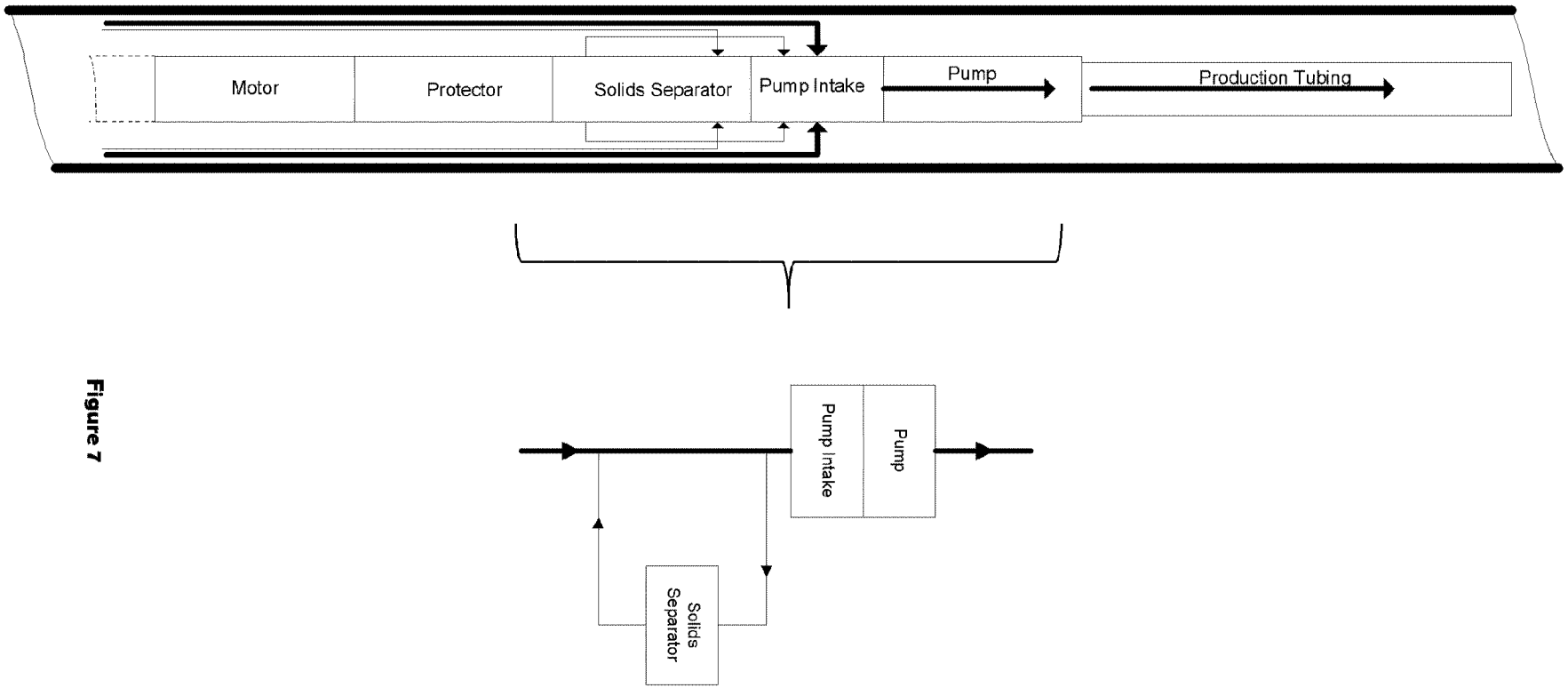
FIG. 7 is an illustration of the well fluid flow distribution.

Referring to FIG. 7 there is shown a schematic depicting the fluid flow inside the casing and its distribution. The fluid from the formation is drawn by the pump through the pump intake 6. A small portion of the overall fluid is ingested by the solid separator inlet and it is exhausted back into the flow inside the casing through the solids separator two or more outlets. The solids separator is designed to handle a fixed amount of fluid regardless of the size of the pump and the protector is protecting. The volume of fluid handled by the solids separator only depends on the speed at the given operating point of the pump. This fixed amount of fluid is dynamically filtered and used to flush the bearing and maintain the shaft seal cavity clean from solids.

The separator is located between the pump intake and the motor. Where a protector is used, it is placed between the pump intake and the protector, however, the separator may be used without a protector, particularly when the motor is canned or otherwise protected from or impervious to corrosive wellbore fluids.

It can be beneficial to allow fluid to pass through the motor both from above and beneath the motor, and pressure in the well may alter so that the usual pressure gradients are reversed. In such cases, a separator may be placed beneath the motor, typically in addition to the separator above the motor.

The key to the apparatus is the multi-stage dynamic filtration system; employing at least two stages that dispose of the various particle sizes.

Kinetic energy is imparted to the solids in the solid laden fluid, and the acceleration given to the drawn-in particles causes them to be ejected them back into the well bore fluid stream. In this manner, only clean fluid remains after the last stage of filtration.

Clean fluid may then be circulated through sleeve bearings to replenish the well bore fluid that is contact with the top mechanical shaft seal. The circulation of clean fluid protects the seal while lubricating the separator's bearings.

The action of the multiple filtration stages ensure that only clean fluid is provided and circulated in the chamber that is in close proximity to the protector shaft seal, the clean filtered fluid in the seal area ensuring long run life.

The apparatus is ideally used with canned motors to ensure only clean filtered fluid can enter the rotor cavity, since the canned motors can be designed to withstand the presence of corrosive well fluid. The protector is simplified or dispensed with to remove the seal and allow the seal and motor bearings to operate in clean well bore fluid. The separator can though be used beneficially with existing protectors.

The motor rotor cavity is pressure balanced by a filter medium which allows fluid to both enter and leave the rotor cavity but no solids can enter the rotor cavity.

In the example illustrated, the fins of impellor of subassembly 131 and the auger of the separator section 108 are configured to operate when the assembly is rotated in a particular direction. The fins and auger could be configured in the opposite sense to operate with the assembly rotating in the opposite direction. Further, two sets of impellor fins and augers could be provided in series, so that one set is operating to separate particles entrained in the fluid whichever direction the assembly is rotated.

The invention claimed is:

1. An electric submersible pump system, comprising: an electric motor comprising a first drive shaft; a motor protector disposed uphole from the electric motor, wherein the motor protector comprises a second drive shaft that is coupled to the first drive shaft and a mechanical shaft seal associated with the second drive shaft and disposed at an uphole end of the motor protector; a solids separator disposed uphole from the motor protector and coupled to the motor protector, wherein the solids separator comprises a housing interiorly defining a clean cavity at a downhole end of the housing that encloses the mechanical shaft seal of the motor protector, interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a third drive shaft coupled to the second drive shaft, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports; a pump intake disposed uphole of the solids separator; and a pump disposed uphole of the pump intake and fluidically coupled to the pump intake, the pump having a fourth drive shaft that is coupled to the third drive shaft.

2. The electric submersible pump assembly according to claim 1, wherein the solids separator is configured to receive reservoir fluid through the inlet ports, to separate solids from the reservoir fluid, to exhaust solids via the first plurality of exit ports, to separate fine solids from the reservoir fluid, to exhaust fine solids via the second plurality of exit ports, and to flow the reservoir fluid substantially free from solids and fine solids to the clean cavity.

3. The electric submersible pump assembly according to claim 1, wherein the third drive shaft defines a fluid path for circulating the reservoir fluid substantially free from solids and fine solids.

4. The electric submersible pump assembly according to claim 1, wherein the solids separator comprises journal bearings located uphole of the clean cavity and located downhole of the fine solids separator and the solids separator defines a fluid path through or around the journal bearings.

5. The electric submersible pump assembly according to claim 4, wherein the solids separator is configured to flow reservoir fluid substantially free from solids and fine solids via the fluid path through or around the journal bearings to the clean cavity wherein the reservoir fluid substantially free from solids and fine solids lubricates and flushes the journal bearings.

6. The electric submersible pump assembly according to claim 1, wherein the solids separator is configured to operate in vertical and horizontal orientations.

7. The electric submersible pump assembly according to claim 1, wherein the flow inducer comprises a variable pitch auger.

8. The electric submersible pump assembly according to claim 1, wherein the flow inducer comprises a wide pitch impeller.

9. The electric submersible pump assembly according to claim 1, wherein the flow inducer comprises a first variable pitch auger and a first wide pitch impeller configured to separate solids from the reservoir fluid when the third drive shaft rotates in a first direction and comprises a second variable pitch auger and a second wide pitch impeller configured to separate solids from the reservoir fluid when the third drive shaft rotates in a second direction, wherein the second direction of rotation is opposite to the first direction of rotation.

10. The electric submersible pump assembly according to claim 1, wherein the solids separator provides first and second stages that dispose of various sizes of solids.

11. The electric submersible pump assembly according to claim 10, wherein the first stage of the solids separator comprises the flow inducer, the separation cavity, and the first plurality of exit ports and the second stage of the solids separator comprises the fine solids separator and the second plurality of exit ports.

12. The electric submersible pump assembly according to claim 1, wherein the separation cavity of the solids separator defines a first conical interior surface which is narrower at its uphole end than at its downhole end, wherein the separation cavity of the solids separator defines a second conical interior surface located downhole of the first conical interior surface and which is wider at its uphole end than at its downhole end, and wherein the first plurality of exit ports are located at a junction between the first conical interior surface and the second conical interior surface.

13. The electric submersible pump assembly according to claim 1, wherein the fine solids separator comprises a plurality of funnel-shaped impellers.

* * * * *